US011065877B2

(12) United States Patent
Fujiwara

(10) Patent No.: US 11,065,877 B2
(45) Date of Patent: Jul. 20, 2021

(54) DRYING DEVICE AND INKJET PRINTER THEREWITH

(71) Applicant: Oki Data Corporation, Tokyo (JP)

(72) Inventor: Yasuhiro Fujiwara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/542,605

(22) Filed: Aug. 16, 2019

(65) Prior Publication Data

US 2020/0094580 A1 Mar. 26, 2020

(30) Foreign Application Priority Data

Sep. 21, 2018 (JP) ..... JP2018-176849

(51) Int. Cl.

| | |
|---|---|
| ***B41J 2/17*** | (2006.01) |
| ***B41J 11/00*** | (2006.01) |
| ***B41J 29/377*** | (2006.01) |
| ***B41M 7/00*** | (2006.01) |
| ***B41J 29/13*** | (2006.01) |

(52) U.S. Cl.

CPC ..... *B41J 2/1714* (2013.01); *B41J 11/002* (2013.01); *B41J 11/0022* (2021.01); *B41J 11/0024* (2021.01); *B41J 29/13* (2013.01); *B41J 29/377* (2013.01); *B41M 7/009* (2013.01)

(58) Field of Classification Search

CPC ..... B41J 11/002; B41J 2/1714

See application file for complete search history.

(56) References Cited

U.S. PATENT DOCUMENTS

| | | | | |
|---|---|---|---|---|
| 5,005,025 | A * | 4/1991 | Miyakawa | B41J 11/002 101/424.1 |
| 6,390,618 | B1 * | 5/2002 | Wotton | B41J 11/002 347/102 |
| 6,464,328 | B1 * | 10/2002 | Hiramatsu | B41J 2/1714 347/34 |
| 6,648,465 | B2 * | 11/2003 | Gil | B41J 11/002 347/102 |
| 2002/0095818 | A1 * | 7/2002 | Jain | F26B 25/006 34/448 |
| 2005/0151816 | A1 * | 7/2005 | Fellingham | F26B 13/105 347/102 |
| 2014/0176639 | A1 * | 6/2014 | Tunmore | B41J 11/002 347/25 |

(Continued)

FOREIGN PATENT DOCUMENTS

JP 2015-024647 A 2/2015

*Primary Examiner* — Shelby L Fidler

(74) *Attorney, Agent, or Firm* — Muncy, Geissler, Olds & Lowe, P.C.

(57) ABSTRACT

A drying device for drying a recording medium includes a medium guide part that guides the recording medium; a heating body that heats the medium guide part; a cover that is arranged opposing the medium guide part such that the medium carrying path intervenes between the cover and the medium guide part and an air flow path is formed with the medium guide part and the cover; a fan that generates an air flow; and (e) a duct that is configured to discharge the air in the air flow path together with a vapor generated as the recording medium is heated, wherein an air intake port that takes the air in the air flow path into the duct is formed on the downstream side of the flow direction with resect to the heating body.

17 Claims, 9 Drawing Sheets

(56) References Cited

U.S. PATENT DOCUMENTS

| | | | | |
|---|---|---|---|---|
| 2015/0314616 | A1* | 11/2015 | Shinjo | B41J 29/38<br>347/102 |
| 2016/0332464 | A1* | 11/2016 | Harayama | B41J 11/002 |
| 2018/0004143 | A1* | 1/2018 | Sasaki | B41J 11/002 |

* cited by examiner

*Comparative Embodiment*

DRYING DEVICE AND INKJET PRINTER THEREWITH

TECHNICAL FIELD

The present invention relates to a drying device and an inkjet printer.

BACKGROUND

Conventionally, in an image forming apparatus such as a printer, a copying machine, a facsimile machine, or a multifunction machine, for example, in an inkjet printer, a carriage is moved along a rail, and an ink is discharged from a recording head mounted on the carriage and adheres to a recording medium, and thereby, an image of characters, pictures, and the like is formed, and printing is performed.

However, in the inkjet printer, a drying device for drying the ink adhered to the recording medium is arranged. The drying device includes a front paper guide on a front side of a frame of the inkjet printer for guiding the recording medium ejected in a horizontal direction from a platen after printing has been performed, and a planar heater is attached to a back side of the front paper guide. Then, when the front paper guide is heated by energizing the planar heater, the recording medium carried along the front paper guide is heated to an appropriate temperature and the ink adhered to the recording medium is dried (for example, see Patent Document 1).

RELATED ART

[Patent Doc. 1] JP Laid-Open Patent Application Publication 2015-24647

However, in the above-described conventionally drying device, the front paper guide is exposed to outside of the inkjet printer. Therefore, the temperature of the front paper guide cannot be sufficiently high and a time period required to dry the ink is long.

Therefore, a drying device has been provided in which the front paper guide is surrounded by a cover in order to allow a temperature of the front paper guide to become sufficiently high and to prevent an operator from touching the front paper guide at a high temperature or from touching the recording medium in a state in which the ink is not completely dry.

However, in the drying device, when a vapor generated when the ink is dried stays between the front paper guide and the cover, humidity of an atmosphere increases and ink drying efficiency decreases.

Therefore, it is conceivable that the ink drying efficiency can be increased by discharging the vapor generated when the ink is dried to outside of a case of the inkjet printer using a fan or the like. However, in this case, due to an air flow formed by the fan or the like, the front paper guide is cooled. As a result, the ink drying efficiency cannot be sufficiently increased.

The present invention is intended to solve the problem of the conventional drying device and to provide a drying device and an inkjet printer that allow drying efficiency of an ink adhered to a recording medium to be sufficiently increased.

SUMMARY

A drying device for drying a recording medium, disclosed in the application, includes: (a) a medium guide part that guides the recording medium on which printing has been performed along a medium carrying path in a carrying direction of the recording medium wherein the recording medium is carried from an upstream side to a downstream side of the medium carrying path; (b) a heating body that heats the medium guide part; (c) a cover that is arranged opposing the medium guide part such that the medium carrying path intervenes between the cover and the medium guide part and an air flow path, which extends along the medium carrying path, is formed with the medium guide part and the cover; (d) a fan that generates an air flow into the air flow path such that air contained inside the air flow path runs in a flow direction of the air; and (e) a duct that is configured to discharge the air in the air flow path together with a vapor generated as the recording medium is heated Further, an air intake port that takes the air in the air flow path into the duct is formed on the downstream side of the flow direction with resect to the heating body.

According to the present invention, the drying device includes: a medium guide part for guiding a recording medium after printing has been performed to a downstream side in a carrying direction of the recording medium; a heating body that heats the medium guide part; a cover that is arranged opposing the medium guide part and forms an air flow path with the medium guide part; a fan that forms an air flow in the air flow path; and a duct for discharging air in the air flow path together with a vapor generated as the recording medium is heated.

Then, an air intake port for taking air in the air flow path into the duct is formed on a downstream side of the heating body in a flow direction of the air in the air flow path.

In this case, the air intake port for taking are in the air flow path into the duct is formed on a downstream side of the heating body in the flow direction of the air in the air flow path. Therefore, that the medium guide part is cooled by the air entering from the outlet of the recording medium into the air flow path can be prevented. Therefore, drying efficiency of the ink adhered to the recording medium can be sufficiently increased.

BRIEF DESCRIPTION OF THE DRAWINGS

In FIG. 9, a plurality of air intake ports AD is shown.

DETAILED DESCRIPTIONS OF THE PREFERRED EMBODIMENT(S)

In the following, an embodiment of the present invention is described in detail with reference to the drawings. In this case, an inkjet printer as an image forming apparatus is described.

Figure 2:
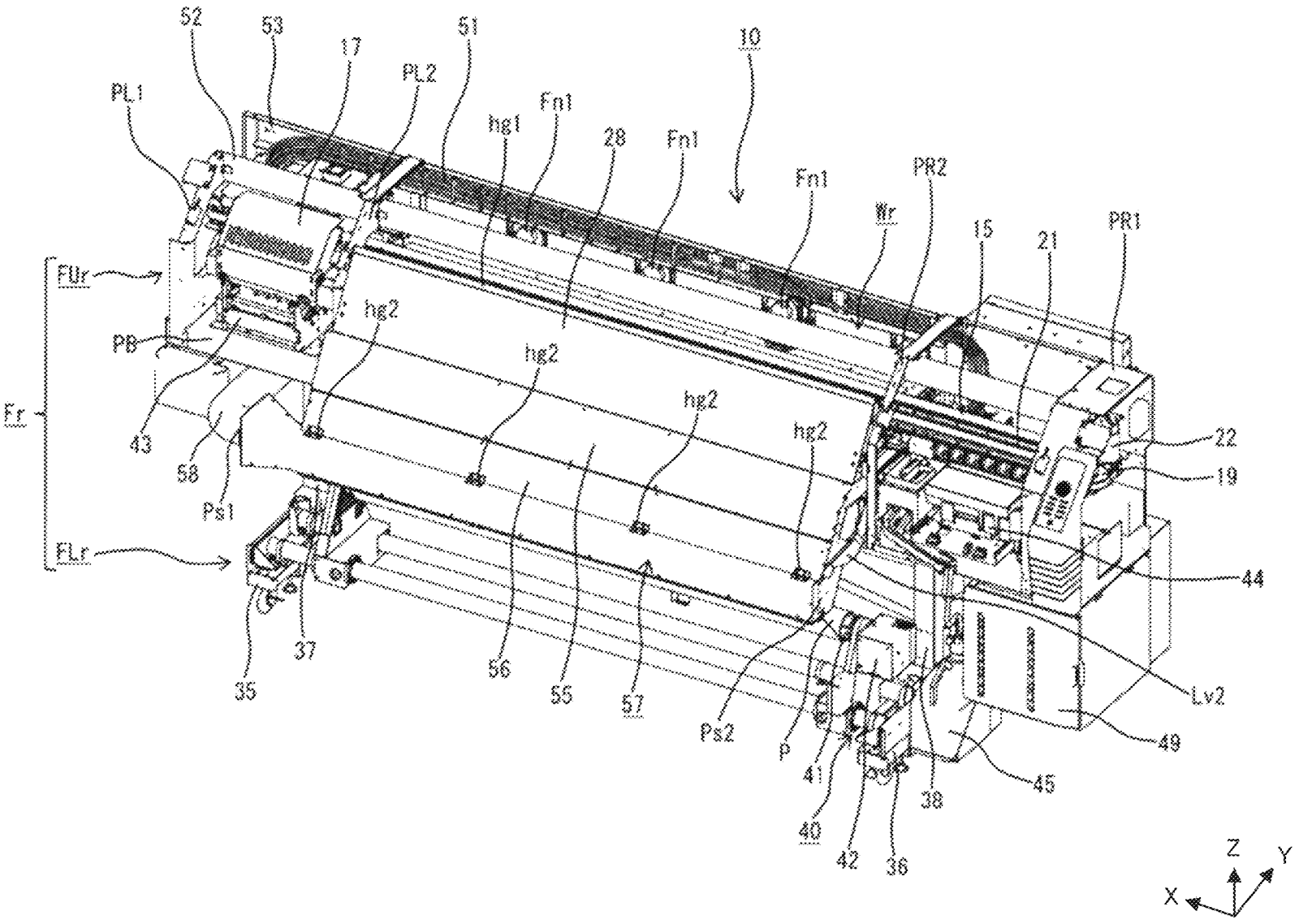
FIG. 2 is a perspective view of an inkjet printer in the embodiment of the present invention.
Figure 3:
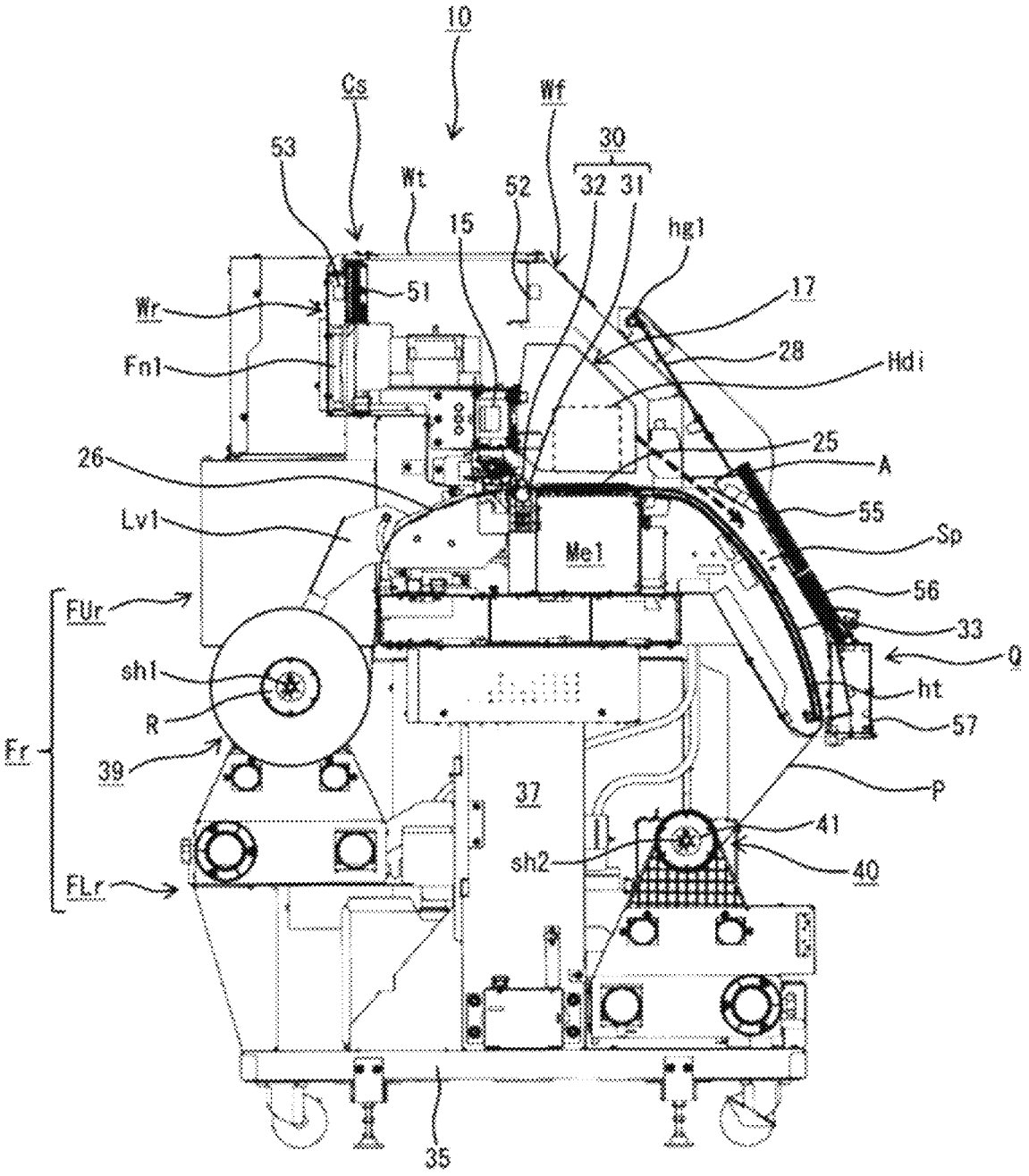
FIG. 3 is a cross-sectional view of the inkjet printer in the embodiment of the present invention.
Figure 3:
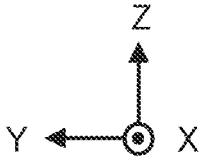
Figure 4:
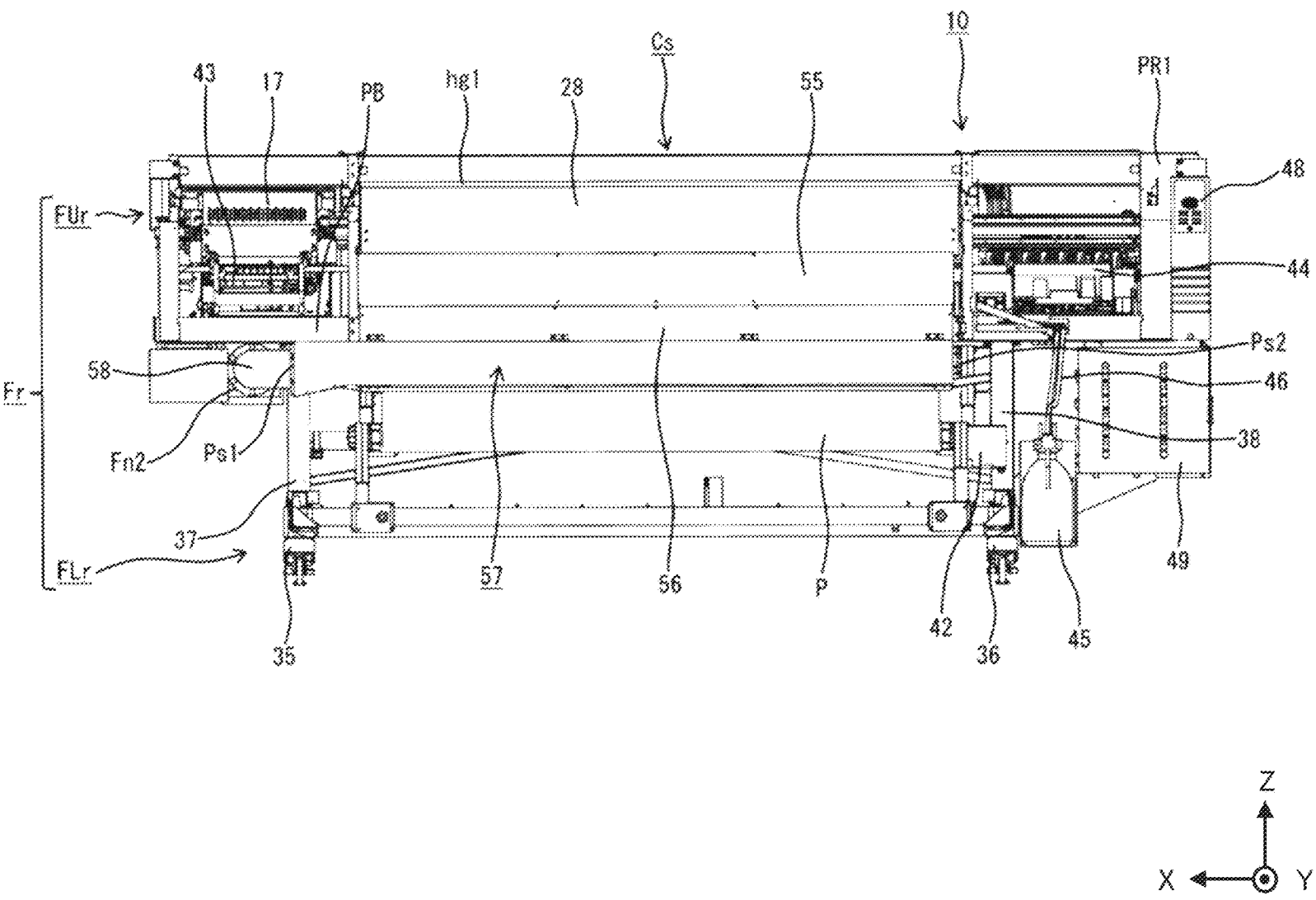
FIG. 4 is a front view of the inkjet printer in the embodiment of the present invention.

FIG. 2 is a perspective view of an inkjet printer in an embodiment of the present invention. FIG. 3 is a cross-sectional view of the inkjet printer in the embodiment of the present invention. FIG. 4 is a front view of the inkjet printer of the embodiment of the present invention.

In the drawings, "10" denotes the inkjet printer, and "Fr" denotes a frame. The frame Fr includes a lower frame FLr, and an upper frame FUr arranged above the lower frame FLr.

The upper frame FUr includes: a receiving plate PB that is arranged extending from a left end to a right end when the inkjet printer 10 is viewed from a front side (near side in FIG. 2); a side plate PL1 as a first main support part that is formed rising up from a left end of the receiving plate PB; a side plate PR1 as a second main support part that is formed rising up from a right end of the receiving plate PB; a frame PL2 as a first auxiliary support part that formed rising up from the receiving plate PB at a position on a right side of and a predetermined distance from the side plate PL1; and a frame PR2 as a second auxiliary support part that is formed rising up from the receiving plate PB at a position on a left side of and a predetermined distance from the side plate PR1.

The lower frame FLr include: pedestals 35, 36 that are arranged in parallel at a predetermined distance from each other between a vicinity of the left end and a vicinity of the right end of the inkjet printer 10; and supporting posts 37, 38 that are respectively formed rising up from centers of the pedestals 35, 36 and support the upper frame FUr at upper ends thereof.

Further, in FIG. 3, "Cs" denotes a first case that forms a portion surrounding between the frames PL2, PR2, the portion being a portion of an external covering body surrounding the frame Fr. The first case Cs includes: a top wall Wt that covers an upper surface between the frames PL2, PR2; a front wall Wf that extends obliquely downward from a front part of the top wall Wt; and a rear wall Wr that extends downward from a rear end part of the top wall Wt. A front cover 28 as a first cover for an operator to access interior of the first case Cs is openably and closably arranged on the front wall Wf (or taking two different positions that are open position and close position). The front cover 28 extends between the frames PL2, PR2 and is swingably supported with respect to the front wall Wf by a hinge hg1 as a first swing support part that is arranged on an upper end of the front cover 28. A second case (not illustrated in the drawings) which is formed separated from the first case Cs surrounds between the side plate PL1 and the frame PL2 and between the side plate PR1 and the frame PR2.

A rail 15 is arranged in a scanning direction of the inkjet printer 10, along which the inkjet printer head moves, between the side plates PL1, PR1. A carriage 17 is movably arranged in a left-right direction, that is, a main scanning direction along the rail 15. In the present embodiment, a plurality of recording heads Hdi (i=1, 2, . . . ) are mounted on the carriage 17. The recording heads Hdi are arranged such that a nozzle face having nozzles (not illustrated in the drawings) faces downward. It is noted that, in the technical field of ink jet printers, a direction in which carriage 17 runs is termed a scanning direction.

A driving side pulley 19 is rotatably arranged on the side plate PR1 and a driven side pulley (not illustrated in the drawings) is rotatably arranged on the side plate PL1. An endless belt 21 is stretched in a travelable manner between the driving side pulley 19 and the driven side pulley. The carriage 17 is attached to a predetermined place of the endless belt 21. A carriage motor 22 as a driving part for moving the carriage is linked to the driving side pulley 19.

Therefore, by driving the carriage motor 22 to cause the endless belt 21 to travel, the carriage 17 can be moved in the main scanning direction and the recording heads Hdi can be moved in the main scanning direction. Then, the recording heads Hdi are driven, and inks of respective colors are discharged from the nozzles and adhere to a recording medium P carried in a direction orthogonal to a movement direction of the carriage 17. Thereby, images such as characters and pictures are formed and printing is performed. As the recording medium P, in addition to a sheet of paper, a resin film such as a vinyl chloride film or a PET film or the like can be used.

The front cover 28 is formed of a transparent material. When the front cover 28 is closed, an operator can observe a state of the interior of the first case Cs via the front cover 28. Further, an operator is prevented by the front cover 28 from touching the carriage 17 and the like.

A linear scale (not illustrated in the drawings) is arranged along the rail 15. A scale marking of the linear scale are read by an encoder (not illustrated in the drawings) arranged in the carriage 17, and a position of the carriage 17 is detected based on a sensor output of the encoder. Further, based on a positional change and time of the carriage 17, a velocity of the carriage 17 can be calculated.

Then, a platen 25 that has a plate-like shape and supports the recording medium P is arranged between the frames PL2, PR2 on the receiving plate PB, and an air suction mechanism Me1 for drawing the recording medium P carried on the platen 25 to the platen 25 by a negative pressure is arranged below the platen 25.

Further, a medium supply part 39 is arranged on a rear side of the supporting posts 37, 38 in the lower frame FLr. A recording medium R in a form of a roll before printing is performed is set on a roll shaft sh1 which is arranged in the medium supply part 39. A medium winding part 40 is arranged on a front side of the supporting posts 37, 38 in the lower frame FLr. A cardboard tube 41 for winding the recording medium P is set on a roll shaft sh2 which is arranged in the medium winding part 40. When a winding motor 42 as a driving part for winding is driven to rotate the roll shaft sh2, the recording medium P after printing has been performed is wound on the cardboard tube 41.

Then, a rear paper guide 26 as a first medium guide part is arranged on a rear side of the platen 25. The rear paper guide 26 guides the recording medium P fed out from the recording medium R, which is in a form of a roll and is set in the medium supply part 39, to the platen 25. For this purpose, a carrying roller pair 30 as a carrying member is rotatably arranged between the rear paper guide 26 and the platen 25.

The carrying roller pair 30 includes a carrying roller 31 as a first roller that is rotatably arranged extending in the main scanning direction along the platen 25, and pinch rollers 32 as second rollers that are respectively rotatably arranged at a plurality of places in the main scanning direction above the carrying roller 31 and press the recording medium P against the carrying roller 31. When a carrying motor (not illustrated in the drawings) as a driving part for carrying is driven to rotate the carrying roller 31, the pinch rollers 32 are rotated by the rotation of the carrying roller 31. As a result, the recording medium P fed out from the recording medium R which is in a form of a roll is carried onto the platen 25 in a state of being sandwiched by the carrying roller 31 and the pinch rollers 32. Then, the recording medium P flatly supported by the platen 25 and the nozzle face of the recording heads Hdi oppose each other, and inks are discharged from the recording heads Hd.

In this case, after the carrying motor has been driven to carry the recording medium P a predetermined distance, the carrying motor is stopped. In this state, the carriage 17 is moved and inks are discharged from the recording heads Hdi, and thereby, one scan is performed and one line worth of an image is formed. When one line worth of the image has been formed, the carrying motor is driven again to carry the recording medium P a predetermined distance, and thereafter, the carriage 17 is moved and inks are discharged from the recording heads Hdi, and thereby, one line worth of the image is formed. By repeating this operation, an image is formed on the recording medium P, and printing is performed.

In the present embodiment, printing is performed using a single pass method. However, when printing is performed using a multi-pass method, the recording medium P is carried a distance shorter than a nozzle column (not illustrated in the drawings) of the recording heads Hdi and a plurality of scans are performed, and thereby, one line worth of the image is formed.

On a front side of the upper frame FUr, a front paper guide 33 as a second medium guide part is provided for guiding the recording medium P after printing has been performed to a downstream side in the carrying direction of the recording medium P, in the present embodiment, to outside of the first case Cs. The front paper guide 33 has a curved shape in order to guide downward the recording medium P ejected in a horizontal direction from the platen 25.

In the present embodiment, a first medium release lever Lv1 is arranged near the rear paper guide 26, and a second medium release lever Lv2 is arranged near the front paper guide 33. By operating the first and second medium release levers Lv1, Lv2, an operator can move the pinch rollers 32 away from the carrying roller 31 and set the recording medium P on the platen 25.

However, in the present embodiment, the rail 15 is arranged between the side plates PL1, PR1, and the platen 25 is arranged between the frames PL2, PR2. Therefore, when the carriage 17 is being moved above the platen 25, discharge of the inks, that is, recording by the recording heads Hdi is performed, and when the carriage 17 is placed between the side plate PL1 and the frame PL2 and when the carriage 17 is placed between the side plate PR1 and the frame PR2, recording by the recording heads Hdi is not performed.

Therefore, in the present embodiment, a place between the side plate PL1 and the frame PL2 is set as a home position for performing origin alignment of the position of the carriage 17, and a place between the side plate PR1 and the frame PR2 is set as a retreat position for allowing the carriage 17 to retreat from above the platen 25 and to turn back.

Then, at the home position, a cap unit 43 is arranged opposing the recording heads Hdi. When the inkjet printer 10 is not used for a long time, the cap unit 43 covers the nozzle face of the recording heads Hdi with a cap to prevent that the viscosity of the inks in the nozzles becomes high and the nozzles are clogged or to prevent that dust and the like adhere to the nozzles.

Further, at the retreat position, a maintenance unit 44 for keeping the nozzles in a good condition is arranged opposing the recording heads Hdi. The maintenance unit 44 periodically wipes the nozzle face or suctions the inks in the nozzles. Then, under the maintenance unit 44, a waste liquid bottle 45 for storing inks discharged from the maintenance unit 44 via a waste liquid tube 46 is arranged.

On the side plate PR1, an operation panel 48 as an operation and display part for operating the inkjet printer 10 is arranged. The operation panel 48 includes an operation part and a display part, the operation part including an operation button and the like and the display part including an indicator lamp and the like.

Further, at the retreat position, an ink main tank chamber 49 is arranged adjacent to the waste liquid bottle 45. In the ink main tank chamber 49, a plurality of ink tanks (not illustrated in the drawings) are accommodated. The inks in the ink tanks are sent to ink sub tanks (not illustrated in the drawings) by first pumps (not illustrated in the drawings), and are temporarily stored in the ink sub tanks, and thereafter, are supplied to the recording heads Hdi via ink tubes 51 by second pumps (not illustrated in the drawings). The ink tubes 51 are arranged in U shapes between a front plate 52 and a rear plate 53 which are arranged at a predetermined distance below the top wall Wt, and deform while changing bending positions along with the movement of the carriage 17, and supply the inks to the recording heads Hdi.

However, in the present embodiment, the inks adhered to the recording medium P which is carried on the platen 25 in the secondary scanning direction is dried by a drying device Q.

For that purpose, in the present embodiment, a platen heater (not illustrated in the drawings) as a first heating body is embedded in the platen 25, a planar heater ht as a second heating body is attached to a back surface of the front paper guide 33, and, by energizing the platen heater and the planar heater ht, the recording medium P carried in the order of the platen 25 and the front paper guide 33 is heated to an appropriate temperature, and drying of the inks adhered to the recording medium P is promoted.

Then, in order to prevent an operator from touching the front paper guide 33 at a high temperature or from touching the recording medium P in a state that the inks are not completely dry, a contact prevention cover 55 as a second cover extending obliquely downward from a lower end of the front cover 28 is provided over the entire front paper guide 33 in a width direction.

Further, in order to remove foreign substances such as paper dust adhered to the front paper guide 33 along with the carrying of the recording medium P, a foreign substance removal cover 56 as a third cover extending obliquely downward from a lower end of the contact prevention cover 55 is openably and closably arranged (or taking two different positions that are open position and close position).

The contact prevention cover 55 and the foreign substance removal cover 56 are arranged at a predetermined distance relative to the front paper guide 33, and an air flow path Sp is formed between the front paper guide 33 and a combination of the contact prevention cover 55 & the foreign substance removal cover 56.

However, when the inks adhered to the recording medium P are dried by the platen 25 and the front paper guide 33, water, a solvent component and the like in the inks are evaporated and thereby a vapor is generated. When the generated vapor stays in the air flow path Sp, humidity in the air flow path Sp is increased and ink drying efficiency is decreased.

Further, driving the recording heads Hdi or heating the recording medium P raises the temperature in the first case Cs.

Therefore, in the present embodiment, suction fans Fn1 are arranged at a plurality of places in the scanning direction near an upper end of the rear wall Wr, and air outside the first case Cs is taken into the first case Cs by the fans Fn1. As a result, an air flow in an arrow A direction is formed in the first case Cs and a temperature rise in the first case Cs is suppressed, and an air flow is formed in the air flow path Sp and a vapor is prevented from staying in the air flow path Sp.

Further, in the present embodiment, the air taken in by the fans Fn1 is discharged together with the vapor to outside of the first case Cs. For that purpose, a vapor discharge duct 57 as a first duct extending downward from a lower end of the foreign substance removal cover 56 is formed over the entire front paper guide 33 in a width direction. The vapor discharge duct 57 is integrally formed with the contact prevention cover 55 and is formed by closing two ends with side panels Ps1, Ps2, and includes a duct space Dc (FIG. 1) (to be described later) for taking in a vapor generated in the air flow path Sp.

Then, the vapor discharge duct 57 is connected to a flexible duct 58 as a second duct at the side panel Ps1 on the home position side. The flexible duct 58 has an "L" shape and extends from the front side to the rear side of the inkjet printer 10, and has an air outlet opened on the rear wall Wr. At the air outlet, similar to the fans Fn1, an exhaust fan Fn2 forming an air flow in the air flow path Sp is arranged.

On an upper end of the vapor discharge duct 57, a plurality of hinges hg2 as a second swing support part are arranged. By the hinges hg2, the foreign substance removal cover 56 is swingably supported with respect to the vapor discharge duct 57.

Next, the drying device Q is described.

Figure 1:
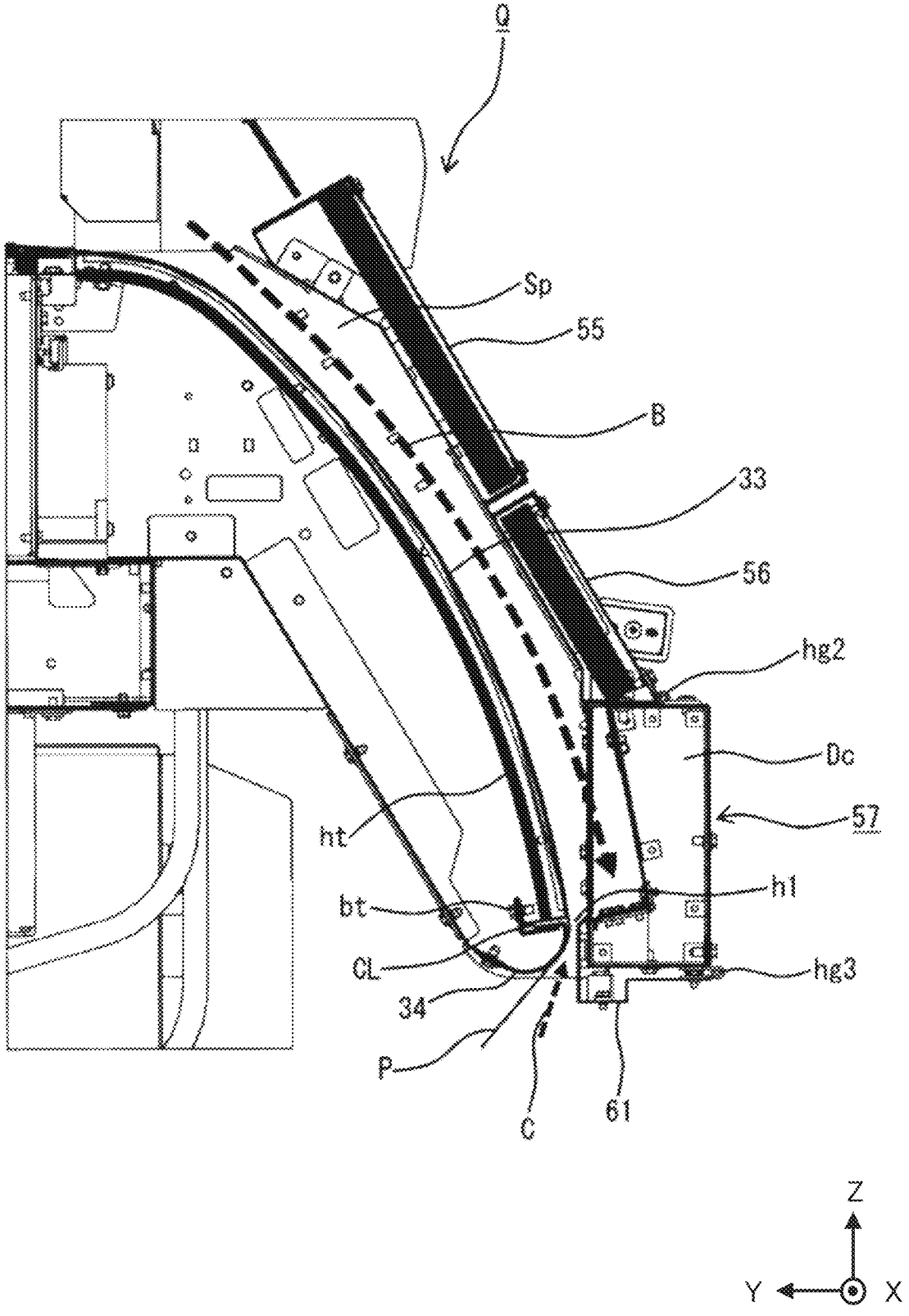
FIG. 1 is a cross-sectional view of a drying device in an embodiment of the present invention.
Figure 5:
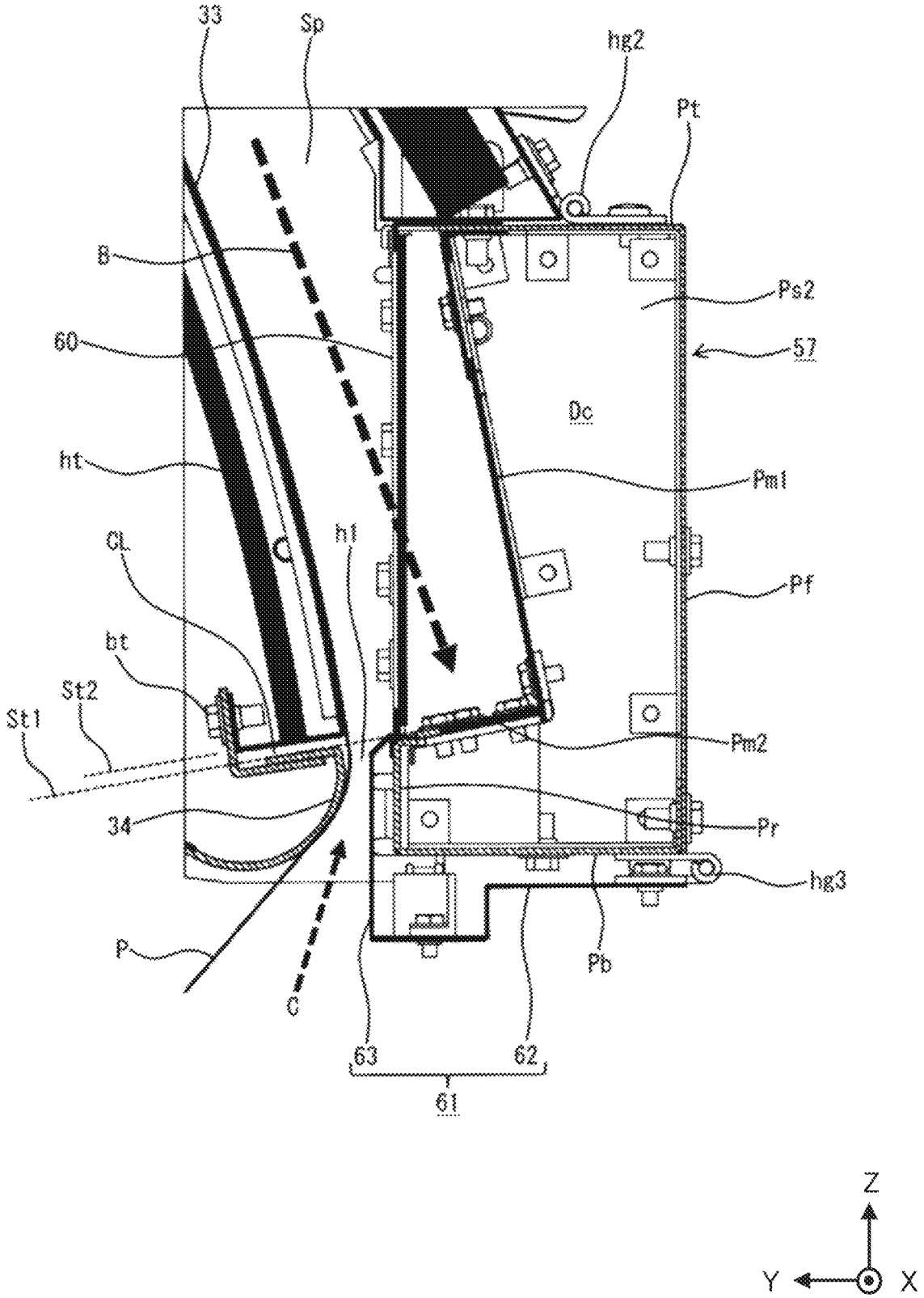
FIG. 5 illustrates a first state of the drying device in the embodiment of the present invention.
Figure 6:
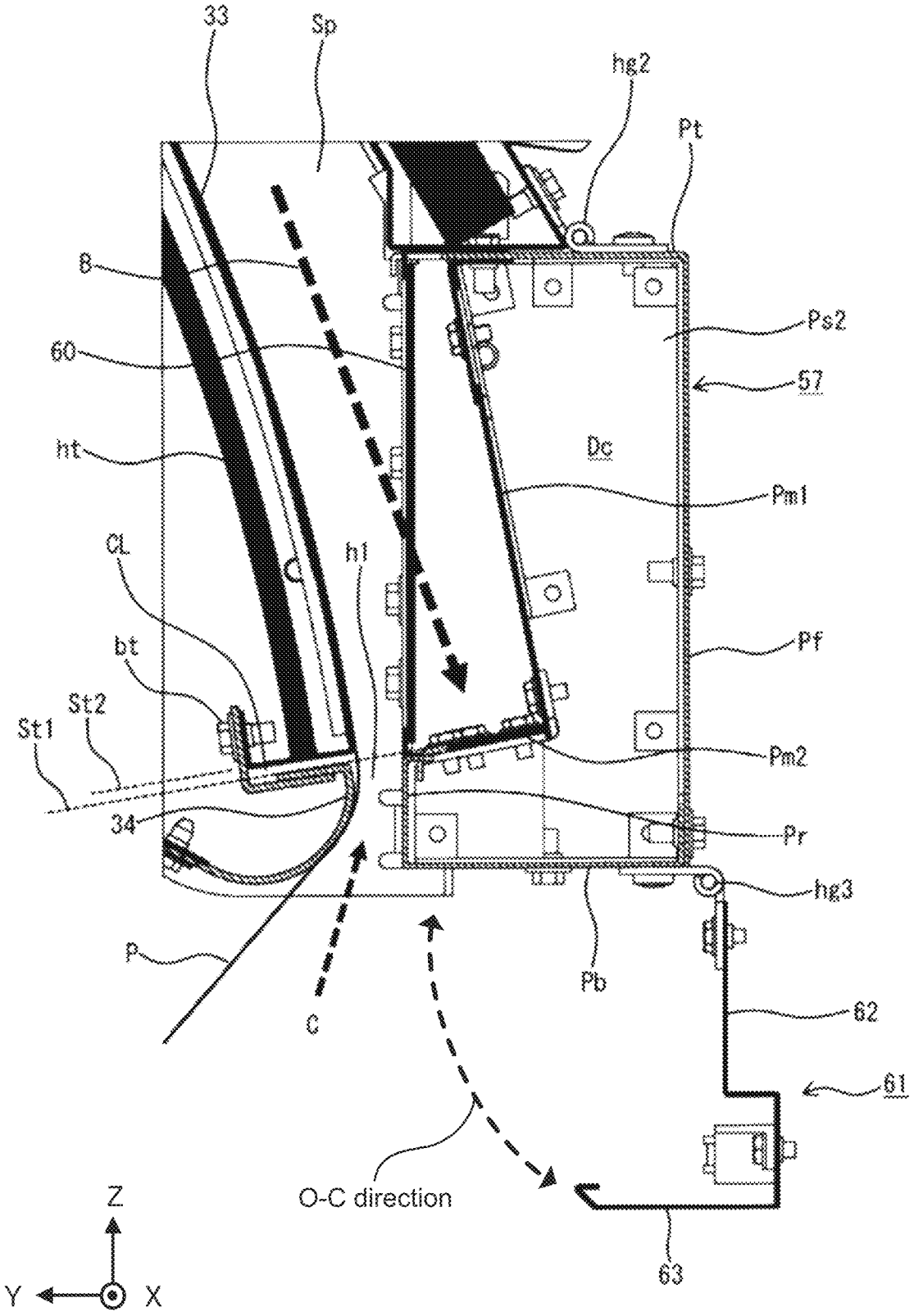
FIG. 6 illustrates a second state of the drying device in the embodiment of the present invention.
Figure 7:
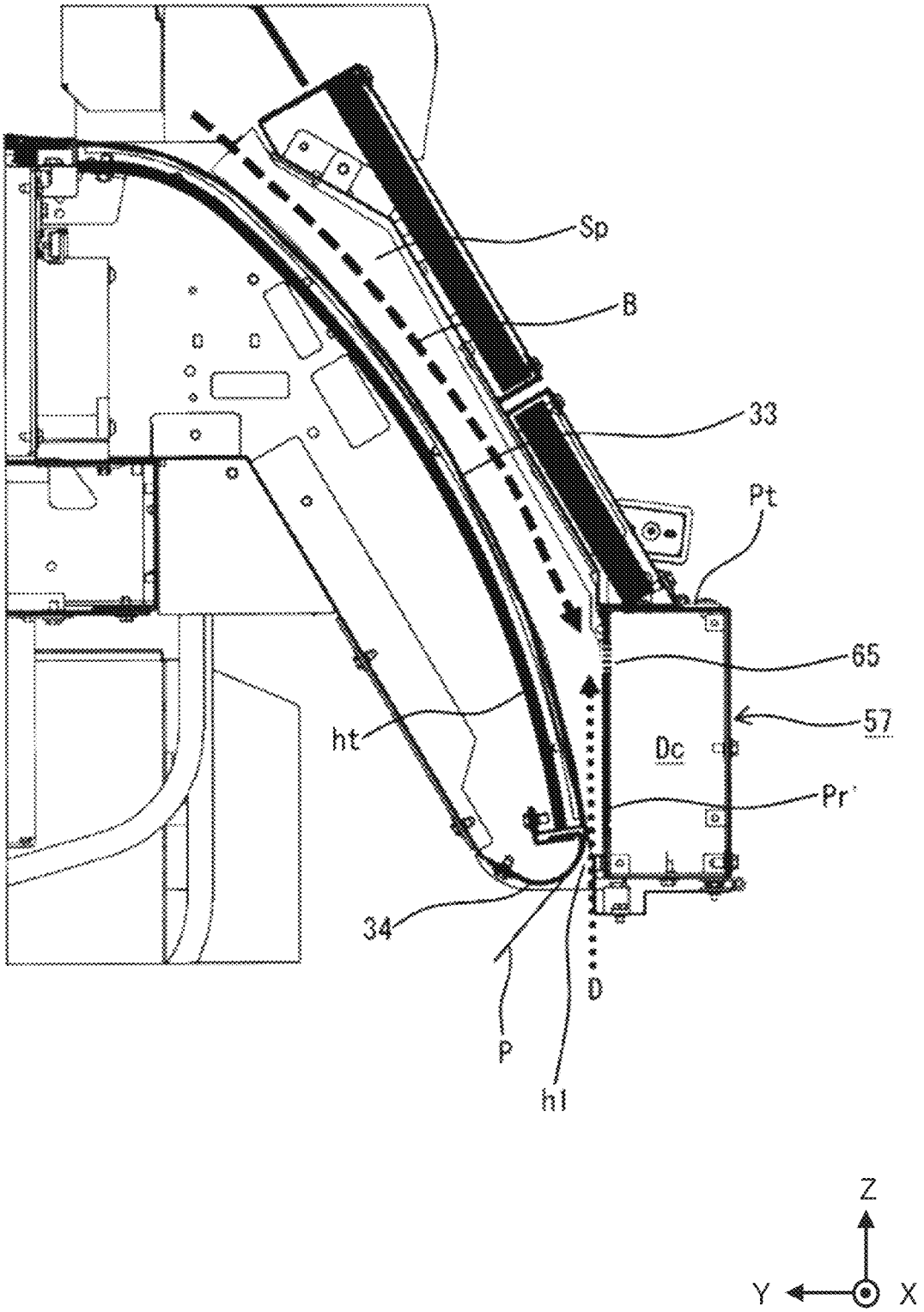
FIG. 7 is a cross-sectional view illustrating a comparative example of the drying device in the embodiment of the present invention.

FIG. 1 is a cross-sectional view of the drying device in the embodiment of the present invention. FIG. 5 illustrates a first state of the drying device in the embodiment of the present invention. FIG. 6 illustrates a second state of the drying device in the embodiment of the present invention. FIG. 7 is a cross-sectional view illustrating a comparative example of the drying device in the embodiment of the present invention.

In the drawings, "Q" indicates the drying device; "P" indicates the recording medium; "Sp" indicates the air flow path; "33" indicates the front paper guide; "34" indicates an ejection part paper guide that has a "U" shape, and is connected to the front paper guide 33 by a screw bt at an outlet h1 of the recording medium P formed at a lower end of the front paper guide 33, and guides the recording medium P toward the medium winding part 40 (FIG. 2); "55" indicates the contact prevention cover; "56" indicates the foreign substance removal cover; "57" indicates the vapor discharge duct; "60" indicates a medium protection cover as a fourth cover; and "61" indicates an auxiliary cover as a fifth cover that is openably and closably arranged and selectively surrounds a lower end part of the vapor discharge duct 57.

The contact prevention cover 55 is arranged to oppose an upper half portion of the front paper guide 33; the foreign substance removal cover 56 is arranged to oppose a central portion of the front paper guide 33; and the vapor discharge duct 57 is arranged to oppose a lower end portion of the front paper guide 33.

The planar heater ht is attached (or fixed) to a back surface of the front paper guide 33 and the front paper guide 33 is maintained at a high temperature by the planar heater ht, whereas a planar heater is not arranged on a back surface of the ejection part paper guide 34 and the ejection part paper guide 34 is maintained at a low temperature. Further, an air gap CL of about a several [mm] as a heat insulation part is formed between the front paper guide 33 and the ejection part paper guide 34, and the front paper guide 33 and the ejection part paper guide 34 are thermally separated from each other. The other surface of the front paper guide 33, which is different from the back surface, is defined as a front surface.

The vapor discharge duct 57 includes a front panel Pf, a top panel Pt, a base panel Pb, a rear panel Pr which is formed by rising up from the base panel Pb in parallel to the front panel Pf, and the side panels Ps1, Ps2, and includes a guide panel Pmt which extends obliquely forward and downward from a vicinity of a rear end of the top panel Pt, and an air intake panel Pm2 which extends obliquely forward and upward from an upper end of the rear panel Pr and of which a front end is connected to a lower end of the guide panel Pm1. The duct space Dc is formed by the front panel Pf, the top panel Pt, the base panel Pb, the rear panel Pr, the side panels Ps1, Ps2, the guide panel Pm1 and the air intake panel Pm2.

Figure 8:
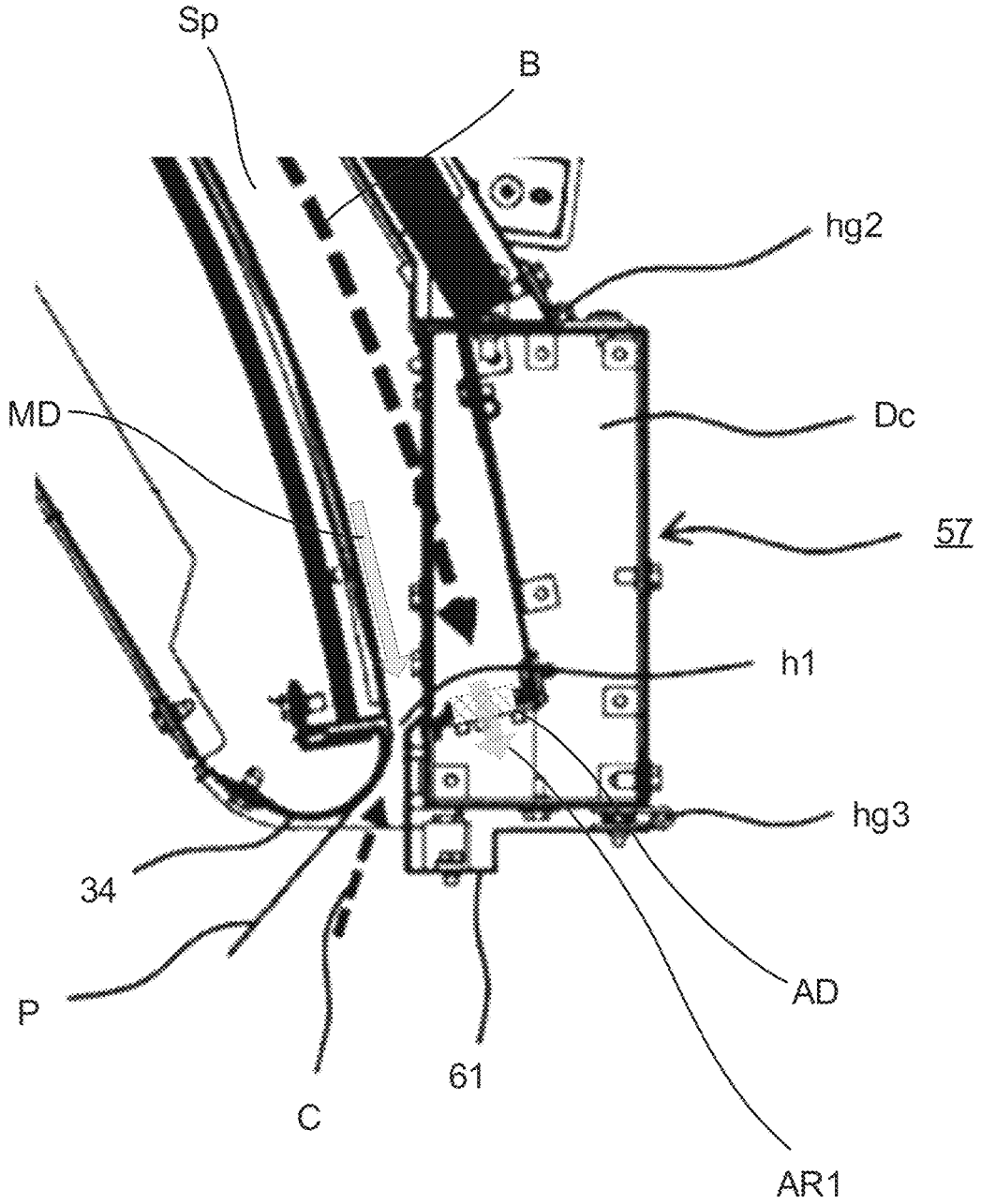
FIG. 8 in an enlarged view of an area where an air intake port is plate at the center.
Figure 8:
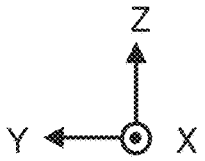
Figure 9:
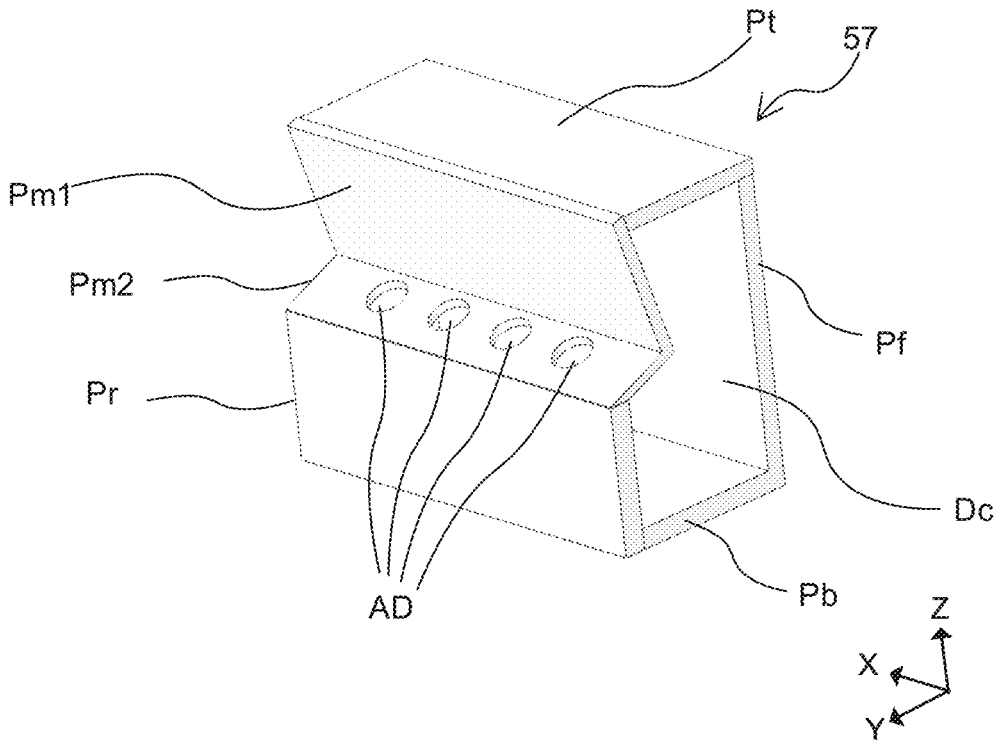
FIG. 9 is a perspective view illustrating simplified vapor discharge duct 57. Duct space Dc is defined with six panels (Pt, Pf, Pb, Pr, Pm1 and Pm2), extending in the width direction (X direction).

A plurality of air intake ports are formed over the entire air intake panel Pm2 in the width direction of the front paper guide 33. The air intake ports are formed in a direction intersecting a flow direction (arrow B direction) of the air in the air flow path Sp and the carrying direction (MD in FIG. 8) of the recording medium P, in the present embodiment, in a direction substantially perpendicular to the flow direction of the air. The carrying direction MD is determined in the vicinity of the air intake port. That is, the carrying direction of the recording medium P and the direction along which the air intake panel Pm2 extends are at an angle of 90±10 [degrees] to each other. Therefore, air can be taken into the duct space Dc from the air intake ports without changing the flow direction. The air direction of air passing through the air intake ports is shown with arrow AR1 in FIG. 8. Further, the air intake ports are opened toward an upstream side in the flow direction of the air in the air flow path Sp and in the carrying direction of the recording medium P. Putting it another way, an imaginary opening surface of the air intake port intersects with the air flow direction (or direction with Arrow B). In this embodiment, the air intake ports are formed to intersect with the air flow direction at about 90 degrees. The air intake ports are formed at a downstream side of the air flow path Sp. The air inside the air flow path Sp is taken to the duct space Dc passing through the air intake ports. In FIG. 8, an area where the air intake ports exist is hatched and denoted with AD. The direction in which the air intake ports extend is in X-direction.

The air intake part of the invention may be single. But, under consideration of the size and shape, one or more air intake part may be arranged in the X direction or Y direction. A plurality of the air intake parts may be aligned in X direction and/or in Y-direction (more specifically the direction in which the air intake panel Pm2 is arranged).

Further, in the flow direction of the air in the air flow path Sp and in the carrying direction of the recording medium P, the air intake ports are formed on a downstream side of the planar heater ht. That is, a position St1 of the air intake ports is below a position St2 of a lower end of the planar heater ht.

The medium protection cover 60 is arranged between the rear end of the top panel Pt and the upper end of the rear panel Pr and covers the guide panel Pm1 and the air intake panel Pm2, and surrounds the air intake ports and prevents the recording medium P, which is carried along the front paper guide 33, from interfering with the vapor discharge duct 57. Further, the medium protection cover 60 is formed of a breathable material, in the present embodiment, a mesh-like material, and does not block an air flow. Therefore, air in the air flow path Sp is smoothly taken into the duct space Dc.

Then, the auxiliary cover 61 is arranged on a downstream side of the air intake ports in the flow direction of the air in the air flow path Sp and in the carrying direction of the recording medium P, and is swingably supported with respect to the vapor discharge duct 57 by a hinge hg3 as a third swing support part arranged at an intersection point between the front panel Pf and the base panel Pb. The auxiliary cover 61 includes a first covering part 62 covering the base panel Pb and a second covering part 63 covering the rear panel Pr.

In the present embodiment, the auxiliary cover 61 is arranged on a downstream side of the air intake ports in the flow direction of the air in the air flow path Sp and in the carrying direction of the recording medium P. Therefore, regardless whether the auxiliary cover 61 is opened or closed, the air in the air flow path Sp is taken from the air intake ports into the vapor discharge duct 57 without changing the direction.

Next, an operation of the drying device Q is described.

The recording medium P, to which inks discharged from the recording heads Hdi have adhered and on which an image has been formed on the platen 25 (FIG. 3), is carried to the drying device Q. In the drying device Q, the recording medium P is heated by the front paper guide 33 while being carried on the front paper guide 33, and the inks are dried. Subsequently, the recording medium P is carried on the ejection part paper guide 34 and thereafter is ejected from the drying device Q and is carried to the medium winding part 40 and is wound on the cardboard tube 41 set on the roll shaft sh2.

On the other hand, the air taken into the first case Cs by the fans Fn1 flows in the arrow A direction between the carriage 17 and the front cover 28, and cools the carriage 17, and then, flows in the arrow B direction in the air flow path Sp, and is taken into the duct space Dc via the air intake ports of the vapor discharge duct 57. Then, the air taken into the duct space Dc flows in the vapor discharge duct 57 and in the flexible duct 58, and is discharged from the air outlet to the outside of the first case Cs by the fan Fn2. The fan Fn2 is shown at the left side in FIG. 4.

Then, when the recording medium P is heated by the front paper guide 33 and the inks are dried, a vapor in the air flow path Sp generated by evaporation of water, a solvent component and the like in the inks is taken into the first case Cs by the fans Fn1, and, together with the air flowing in the air flow path Sp, is taken into the duct space Dc via the air intake ports of the vapor discharge duct 57, and flows in the vapor discharge duct 57 and in the flexible duct 58, and is discharged from the air outlet to the outside of the first case Cs by the fan Fn2.

However, as the air is discharged to the outside of the first case Cs by the fan Fn2, a negative pressure is generated in the air flow path Sp. As a result, air outside the first case Cs enters into the air flow path Sp via the outlet h1 in an arrow C direction. Near the air intake ports, an air flow in the arrow B direction from the air flow path Sp toward the air intake ports and an air flow in the arrow C direction from the outlet h1 toward the air intake ports are generated.

In the present embodiment, the air intake ports are opened toward an upstream side in the carrying direction of the recording medium P, and the outlet h1 is positioned on a downstream side of the air intake ports in the carrying direction of the recording medium P. Therefore, air in the air flow path Sp is taken into the duct space Dc more than air entering from the outlet h1. However, in a case where a suction force for taking air into the duct space Dc is constant at the air intake ports, when an amount of air entering from the outlet h1 is large, an amount of air taken from inside of the air flow path Sp to the duct space Dc decreases accordingly.

Therefore, in the present embodiment, the amount of the air entering from the outlet h1 of the recording medium P into the air flow path Sp is changed according to opening and closing of the auxiliary cover 61. That is, when the amount of the air entering from the outlet h1 is large, the auxiliary cover 61 is closed as illustrated in FIG. 5 and the drying device Q is put in the first state to reduce a cross-sectional area of the outlet h1. When the amount of the air entering from the outlet h1 is small, the auxiliary cover 61 is opened as illustrated in FIG. 6 and the drying device Q is put in the second state to increase the cross-sectional area of the outlet h1. Thereby, the amount of the air taken from inside of the air flow path Sp into the duct space Dc is stabilized.

FIG. 5 shows a closed position of the auxiliary cover 61. FIG. 6 shows an open position of the cover. Cover 61 is able to swing between these two positions around hinge hg3. The swing direction is denoted with O-C direction in FIG. 6.

Further, when the auxiliary cover 61 is closed, the amount of the air entering from the outlet h1 can be reduced. However, an area near the outlet h1 is narrowed by an amount of a size of the auxiliary cover 61. Therefore, a recording surface of the recording medium P may be in contact with the vapor discharge duct 57 or the like, image quality may deteriorate due to rubbing, and in a worst case, jamming may occur. Further, when the auxiliary cover 61 is opened, it is possible to suppress or prevent deterioration of image quality or occurrence of jamming. However, as described above, the amount of the air taken from inside of the air flow path Sp into the duct space Dc is reduced.

Further, when the recording medium P is carried, various types of problems may occur depending on the type of the recording medium P. However, by opening and closing the auxiliary cover 61 according to the type of the recording medium P, the various problems can be addressed. For example, in a case where a recording medium P that can be easily distorted is used, when the auxiliary cover 61 is opened, an operation to set the recording medium P in the inkjet printer 10 can be simplified.

In this way, in the present embodiment, the air intake ports for taking the air in the air flow path Sp into the vapor discharge duct 57 are formed on a downstream side of the planar heater ht in the flow direction of the air in the air flow path Sp. Therefore, that the front paper guide 33 is cooled by the air entering from the outlet h1 of the recording medium P into the air flow path Sp can be prevented. Therefore, the inks adhered to the recording medium P can be dried in a short time period, and the ink drying efficiency can be sufficiently increased.

Further, as illustrated in a comparative example of FIG. 7, when the air intake ports 65 are formed near the top panel Pt on a rear panel Pr' of the vapor discharge duct 57, air is taken into the duct space Dc via the air intake ports 65 on an upstream side of the lower end of the front paper guide 33 (the lower end of the planar heater ht) in the carrying direction of the recording medium P. In this case, the front paper guide 33 is cooled by air entering from the outlet h1 in an arrow D direction. Therefore, the inks adhered to the recording medium P cannot be sufficiently dried.

In the present embodiment, the carrying direction of the recording medium P and the flow direction of the air in the air flow path Sp are the same direction. However, it is also possible that the flow direction of the air in the air flow path Sp is a direction different from the carrying direction of the recording medium P, for example, an opposite direction of the carrying direction of the recording medium P.

Further, in the present embodiment, the planar heater ht is attached to the back side of the front paper guide 33 and the inks adhered to the recording medium P are heated by the front paper guide 33. However, it is also possible that the inks are dried by arranging a planar heater as an auxiliary heating body on the contact prevention cover 55, the foreign substance removal cover 56 or the like opposing the front paper guide 33.

In the present embodiment, the inkjet printer 10 is described. However, the present invention can also be applied to an image forming apparatus such as a copying machine, a facsimile machine, a multifunction machine, or the like.

The present invention is not limited to the above embodiment. Based on the spirit of the present invention, various modifications are possible, which are not to be excluded from the scope of the present invention.

What is claimed is:

1. A drying device for drying ink placed on a recording medium by ink jet printing, comprising:

(a) a medium guide part that guides the recording medium on which the ink jet printing has been performed along a medium carrying path in a carrying direction of the recording medium wherein the medium guide part has two surfaces that are a front surface and a back surface opposing each other, the recording medium is carried on the front surface from an upstream side to a downstream side of the medium carrying path, and the medium guide part has a width broader than a width of the recording medium and a predetermined length in the carrying direction to dry the ink;

(b) a heating body that heats the medium guide part wherein the heating body has a planer shape, and is not disposed on the front side of the medium guide part and has predetermined width and length in order to dry the ink on the recording medium while the recording medium runs on the medium guide part;

(c) a cover that is arranged opposing the medium guide part and formed to surround the medium carrying path such that the cover part has a width that is equal to or greater than the width of the recording medium and a predetermined length in the carrying direction to create an air flow path along which air flows is formed, and the medium carrying path and the air flow path intervenes between the cover and the medium guide part;

(d) a fan that generates an air flow and is placed in the air flow path such that the air contained inside the air flow path runs in the same direction as the carrying direction of the recording medium; and (e) a duct that is configured to discharge the air in the air flow path together with a vapor generated from the recording medium, which is heated with the heating body while carried on the medium guide part wherein the duct is a housing having a duct space (Dc), which is hollow, thereinside, and the duct space is defined with several panels, wherein (f) an air intake port, which is an opening to take the air of the air flow path into the duct, is formed on one of the panels, which is defined as an air intake panel (Pm2), (g) the air intake panel is arranged at a position (St1), which is further downstream from a position (St2) at which a downstream edge of the heating body is present with respect to the carrying direction.

2. The drying device according to claim 1, wherein the air intake panel intersects a direction of the air flow path at 90±10 degrees, seen from a width view of the recording medium.

3. The drying device according to claim 2, wherein an outlet (h1) for the recording medium, from which the recording medium is ejected from the drying device, is formed by being surrounded with a downstream edge of the medium guide part and the air intake panel, an area of the outlet is narrower than a cross sectional area of the air flow path, which is measured at a plane perpendicular to the air flow path, and the outlet is positioned on the same plane on which the air intake panel exists.

4. The drying device according to claim 1, wherein the heating body is fixed to the back surface of the medium guide part.

5. The drying device according to claim 1, wherein the air intake panel intersects a direction of the medium carrying path at 90±10 degrees, seen from a width view of the recording medium.

6. The drying device according to claim 5, wherein the air intake port is formed to face a direction substantially perpendicular to the carrying direction of the recording medium.

7. The drying device according to claim 1, further comprising (a) an auxiliary cover that is configured to surround the duct and to selectively take two different positions that are an open position and a close position wherein the auxiliary cover covers the duct at the close position, and does not cover the duct at the open position, the auxiliary cover being arranged on the downstream side of the flow direction with respect to the air intake port, wherein (b) regardless the auxiliary cover being at either the open position or the close position, the air in the air flow path is taken from the air intake port into the duct without changing the flow direction.

8. The drying device according to claim 7, wherein the recording medium, which is carried along the medium carrying path, exits outside the drying device at an outlet for the recording medium, an amount of air entering from the outlet of the recording medium into the air flow path varies according to the position of the auxiliary cover whether at the open position or the close position.

9. The drying device according to claim 1, wherein the duct is integrally formed with the cover that forms the air flow path with the medium guide part.

10. The drying device according to claim 1, further comprising a medium protection cover that is formed of a breathable material, wherein the medium protection cover is arranged between the duct and the medium guide part, seen from a width view of the recording medium.

11. The drying device according to claim 1, wherein the cover, which forms the air flow path with the medium guide part, functions as a contact prevention cover that is configured to prevent an operator from touching the medium guide part or touching the recording medium.

12. The drying device according to claim 1, wherein the cover, which forms the air flow path with the medium guide part, functions as a foreign substance removal cover that is configured to remove foreign substances adhered to the medium guide part as the recording medium is carried, and the cover is configured to take two different positions that are an open position and a close position.

13. An inkjet printer comprising the drying device according to claim 1.

14. The drying device according to claim 1, further comprising:

another fan, wherein the fan, which generates the air flow into the air flow path, is a first fan (Fn1), which is arranged on the upstream side of the air flow path with respect to the heating body, and the anther fan is a second fan (Fn2), and the second fan is arranged on the downstream side of the air flow path with respect to the heating body, and is configured to enhance the air flow to exhaust the air through the duct.

15. The drying device according to claim 1, wherein an opening surface of the air intake port is defined with a peripheral of the opening, which faces the air flow path, and the opening surface intersects with the carrying direction of the recording medium.

16. The drying device according to claim 15, wherein the opening surface is formed such that the opening surface is substantially perpendicular to the carrying direction of the recording medium.

17. The drying device according to claim 1, wherein an outlet (h1) for the recording medium, from which the recording medium is ejected from the drying device, is formed with a downstream edge of the medium guide part and the air intake panel, an area of the outlet is narrower than a cross sectional area of the air flow path, which is measured at a plane perpendicular to the air flow path.

* * * * *